US007351139B2

(12) United States Patent
Sawyer

(10) Patent No.: US 7,351,139 B2
(45) Date of Patent: Apr. 1, 2008

(54) ROYAL GAME AND METHOD OF PLAYING

(76) Inventor: Thomas E. Sawyer, 3101 Riverside Dr., Idaho Springs, CO (US) 80452

( * ) Notice: Subject to any disclaimer, the term of this patent is extended or adjusted under 35 U.S.C. 154(b) by 0 days.

(21) Appl. No.: 10/659,469

(22) Filed: Sep. 11, 2003

(65) Prior Publication Data

US 2004/0160008 A1 Aug. 19, 2004

Related U.S. Application Data

(60) Provisional application No. 60/409,586, filed on Sep. 11, 2002.

(51) Int. Cl.
*A63F 13/00* (2006.01)

(52) U.S. Cl. ..... 463/11

(58) Field of Classification Search ..... 463/11–13, 463/16–22, 25–27, 30–31, 42, 39–40; 273/274, 273/292

See application file for complete search history.

(56) References Cited

U.S. PATENT DOCUMENTS

| | | | | |
|---|---|---|---|---|
| 5,839,732 | A * | 11/1998 | Guidi | 273/292 |
| 5,997,002 | A * | 12/1999 | Goldman | 273/292 |
| 6,994,624 | B2 * | 2/2006 | Gold et al. | 463/12 |
| 2003/0094761 | A1 * | 5/2003 | Furuta et al. | 273/292 |

* cited by examiner

*Primary Examiner*—Robert E Pezzuto
(74) *Attorney, Agent, or Firm*—Amin, Turocy & Calvin, LLP; James J. Bindseil

(57) ABSTRACT

A game played in conjunction with card games and including an auxiliary feature. The game is playable in conjunction with standard card games, such as Poker, using a standard decks of cards or representations thereof. The game is further playable on a gaming table by players and a dealer using cards, or on a computer, other electronic medium, or slot machine. At the time of ante in the card game, each player optionally selects whether to participate in the auxiliary play, for example, by placing an auxiliary ante. Play then proceeds according to the rules of the underlying card game. A player participating in auxiliary play wins a bonus prize if the player does not fold in the underlying card game and if the player holds four "royal" cards (i.e., four face cards (10, Jack, Queen, King, Ace)) of the same suit (e.g., hearts, diamonds, clubs, spades).

38 Claims, 7 Drawing Sheets

ROYAL GAME AND METHOD OF PLAYING

This application claims priority from U.S. Provisional Patent Application Ser. No. 60/409,586 of Thomas E. Sawyer filed Sep. 11, 2002, titled ROYAL GAME AND METHOD OF PLAYING. The entirety of that provisional application is incorporated herein by reference.

BACKGROUND OF THE INVENTION

1. Field of the Invention

This invention relates to a game, and in particular to a casino-style game played with at least one standard deck of cards, the game being played in accordance with the rules of Poker.

2. Background of the Technology

It is known in the art to provide card games, such as Poker, in a casino environment or consistent with casino style rules. In these games, the gaming establishment typically seeks to attract as many participants to a game as possible to increase the money collected at the gaming table. In addition, the number of games played during a specified time, such as the number of hands per hour, is also an important metric used to evaluate the return potential for a game. That is, the more hands that are played during a unit of time, the greater the money collected by the house and the corresponding profit realized.

There is a need for card games having improved play over standard Poker to attract and maintain customer participation. There is a further need for such games that include features, such as additional side betting and special rules of play, to maintain player interest and play after initial dealing of the hand.

SUMMARY OF THE INVENTION

The present invention relates to a method and system for playing a casino style card game, referred to in one embodiment as "The Royal Game," that includes a portion of the game played in conjunction with standard rules for Poker, as described, for example, in John Scarne, "Scarne's Encyclopedia of Games" (1994), including rules for play of Five Card Stud, Five Card Draw, and Seven Card Stud, using a shoe of one or more decks of cards or representations thereof. The game may be played, for example, on a gaming table by players and a dealer using standard cards or, for example, on a terminal, such as a computer or other electronic medium, using representations of various features of the game, which are viewed or otherwise provided to each player, such as via a display device using a graphical user interface (GUI). The terminal can include, for example, a personal computer, minicomputer, microcomputer, or mainframe computer or other device having a processor and a display or coupling to a display, such as an electronic hand-held game device or a personal digital assistant. The game is also playable in electronic form or in conjunction with electronic features over a network, such as the Internet, or using other gaming devices, such as slot machines.

In conjunction with play of Poker during the Poker portion of the game, including standard rules for wagering during play (e.g., placing ante bets and wagers during the course of play), for each hand, prior to dealing any cards, the game of the present invention provides for the optional placement of a selection, including wager, by each player to participate in an auxiliary game (referred to in one embodiment as the "The Royal" side game). Upon a hand that includes four "royal" cards (i.e., four face cards (10, Jack, Queen, King, Ace)) of the same suit (e.g., hearts, diamonds, clubs, spades) being dealt to a player selecting to play the auxiliary game, that player receives a bonus return or is eligible to participate in a bonus event. For example, upon receiving four royal cards of the same suit, the player receives a selected bonus prize or participates in a random selection of a bonus prize. In one embodiment of an electronic version of the present invention, the bonus prize is randomly selected.

In addition to the auxiliary game, an embodiment of the present invention includes use of a payout table or other pay scale for returns on wagers in the Poker portion of the game. In one embodiment of the present invention, the player is able to place one or more wagers during play of the Poker portion of the game.

For example, in one embodiment in which play of the Poker portion of the game is in accordance with rules for Five Card Stud, play occurs as follows. Each player has options, selectable such as via a selection button or buttons for electronic or slot machine games or wager locations for game table versions of the game, to participate in the Poker game portion (e.g., by placement of an ante in an ante location) and to participate in the auxiliary game (e.g., by placement of an auxiliary game ante in the auxiliary game bet location). In an embodiment of the present invention, each player may select to participate in the auxiliary game only if that player has selected to participate in the Poker portion of the game.

In one variation of the Poker portion of the game, each player is dealt two cards down and one card up, in accordance with the rules of Five Card Stud. Each player then selects to place a first wager (e.g., by placing the wager in a first betting location) or to fold. In an embodiment of the present invention, the minimum first wager is equal to the Poker game portion ante amount. Following placement of all first wagers or folding, for each player placing a wager, a second face up card is dealt. Each player then selects to place a second wager (e.g., by placing the wager in a second betting location) or to fold. Following placement of all second wagers or folding, each player is dealt a final card, either face up or face down, depending on house rules. Optionally, in accordance with some house rules, players may also select to trade received cards for newly dealt cards or optionally to pass on betting a second wager, but to elect to remain in the game.

Following dealing of all hands, the hands of each player remaining in the game are revealed, and all wager payouts for the Poker portion of the game are determined. For example, players having hands listed on a payout table are paid returns on their wagers based on the payout table returns indicated (e.g., players having three of a kind receive 2:1 returns on wagers if so indicated in the payout table) or, for example, receiving no return and forfeiting their wagers, including the Poker ante, for hands not meeting minimum qualifications for payout table returns. In other embodiments of the present invention, other returns are usable in addition to those obtained via a pay table, such as by providing returns for winning hands upon comparing hands among players or upon comparing each player's hand to a dealer's hand. In addition, the hands of all players remaining in the game and participating in the auxiliary game are evaluated with regard to the auxiliary game. For example, all players having four "royal" cards receive the bonus prize or are allowed to participate in a random bonus prize selection event (e.g., turn of a prize wheel).

Additional advantages and novel features of the invention set forth in part in the description that follows, considered in conjunction with the accompanying drawing figures, will become more apparent to those skilled in the art upon examination of the following or upon learning by practice of the invention. It is to be understood, however, that the drawings are designed solely for the purposes of illustration and not as a definition of the limits of the invention.

DETAILED DESCRIPTION

Figure 1:
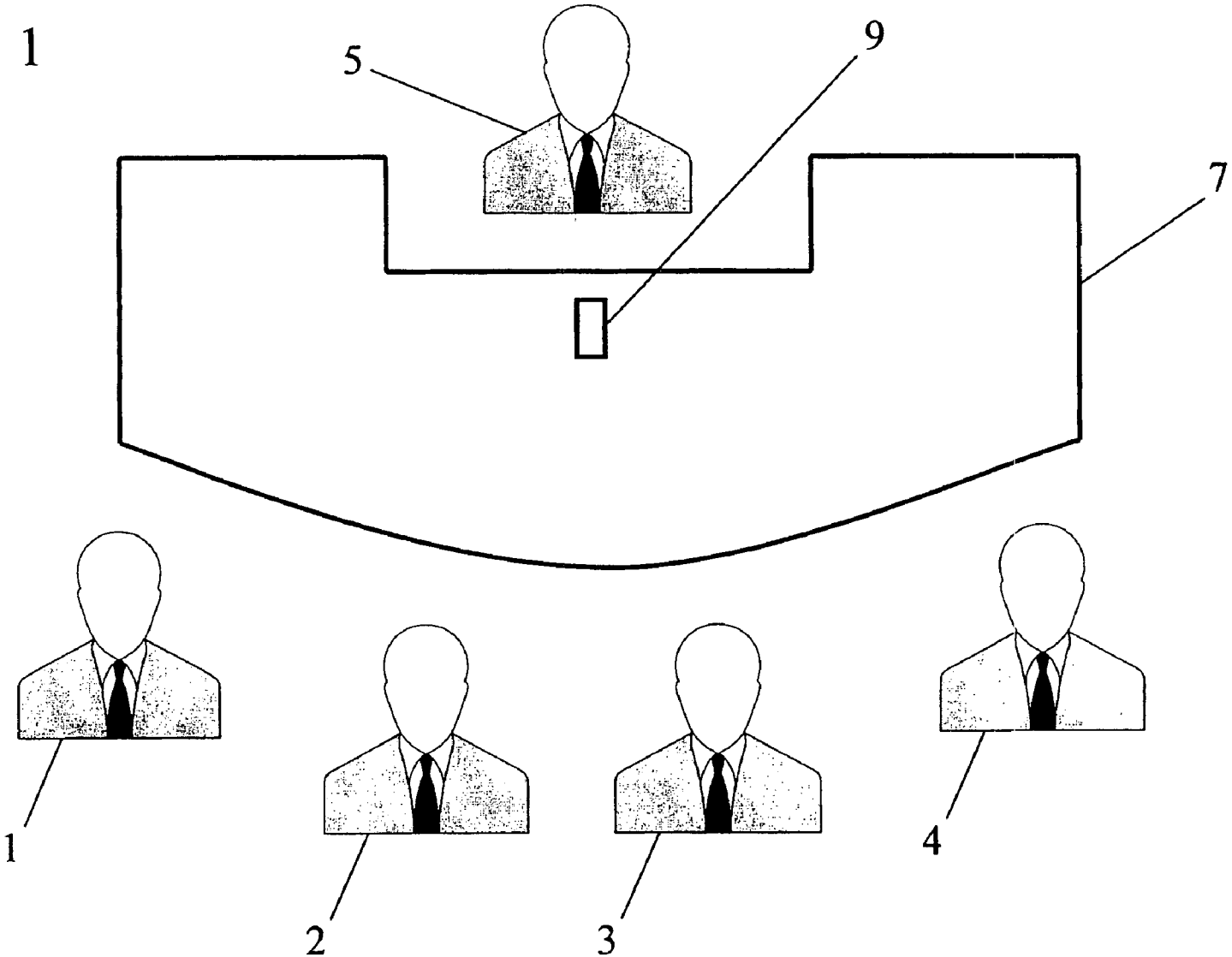
FIG. 1 is an overhead view of the players, dealer, and gaming table for play of the game in accordance one embodiment of the present invention.

An embodiment of the present invention includes two portions that make up the overall game. The first portion of the game, referred to as the Poker game portion, is played in accordance with the rules of Poker, and the game portion is referred to as the auxiliary game portion.

In accordance with an embodiment of the present invention, play is conducted using one or more standard sets of 52 playing cards having values of Ace, 2, 3, 4, 5, 6, 7, 8, 9, 10, Jack, Queen, and King. The game may be optionally played with the Ace as the high or low card, or as optionally selectable as high or low by each player and using one or more Jokers, as, for example, wild cards. Each participating player is seated at, for example, a playing table, as described further below, on the players' side of the table. The dealer is located on the dealer's side of the table, opposite the players. In one embodiment, the table is curved, having a convex side and an opening for the dealer, so that the dealer is easily able to deal to each player from the dealer opening in the table, and up to seven players are easily and comfortably accommodated on the convex side of the table.

The game may also be played with representations of any of the features described. For example, the game is playable in an electronic or partially electronic manner using a terminal, such as a personal computer, microcomputer, minicomputer, mainframe computer, or other device having a processor and display or other device for communicating information to a player, such as an electronic hand-held game device, for which representative images of cards are displayable on a screen via a GUI. The game is also playable in conjunction with performance of selected functions on a network, such as the Internet or an intranet.

The game table used in conjunction with an embodiment of the present invention is a standard blackjack or poker sized casino table, in which a dealer occupies one side of the table and players occupy the other. In one embodiment, the table includes a bar located on the dealer's side of the table. The table also includes the name of the game, such as "The Royal Game."

From the player's side, below the name (toward the players), are player positions for up to seven player spots. At each player's position are four betting spots or areas, one of which is for a Poker game portion ante, one for the auxiliary (Royal) game portion ante, and the other two for first and second bets. At these betting spots, players place chips, for example, for betting as play of the game proceeds. In an embodiment of the present invention, the Poker ante spot is used to indicate selection to play in the game, the auxiliary ante spot is used as an ante bet spot for election to play in the auxiliary game portion, and the two other spots are used for additional betting with respect to the Poker portion of the game.

In an embodiment of the present invention, marked lines are included on the table to clearly delineate each player's position from an adjacent player or players. The clear separation of each player position by the lines serves a number of functions, including preventing cheating, by clearly indicating the area in which a player's money or chips are located.

References will now be made in detail to embodiments of the present invention, examples of which are illustrated in the accompanying drawings.

FIG. 1 is an overhead view of the players, dealer, and gaming table for play of the game in accordance one embodiment of the present invention. FIG. 1 shows an embodiment of the game as played with one to seven players 1, 2, 3, 4 and a dealer 5 at a gaming table 7 using one or more decks of cards located at a card location 9.

Figure 2:
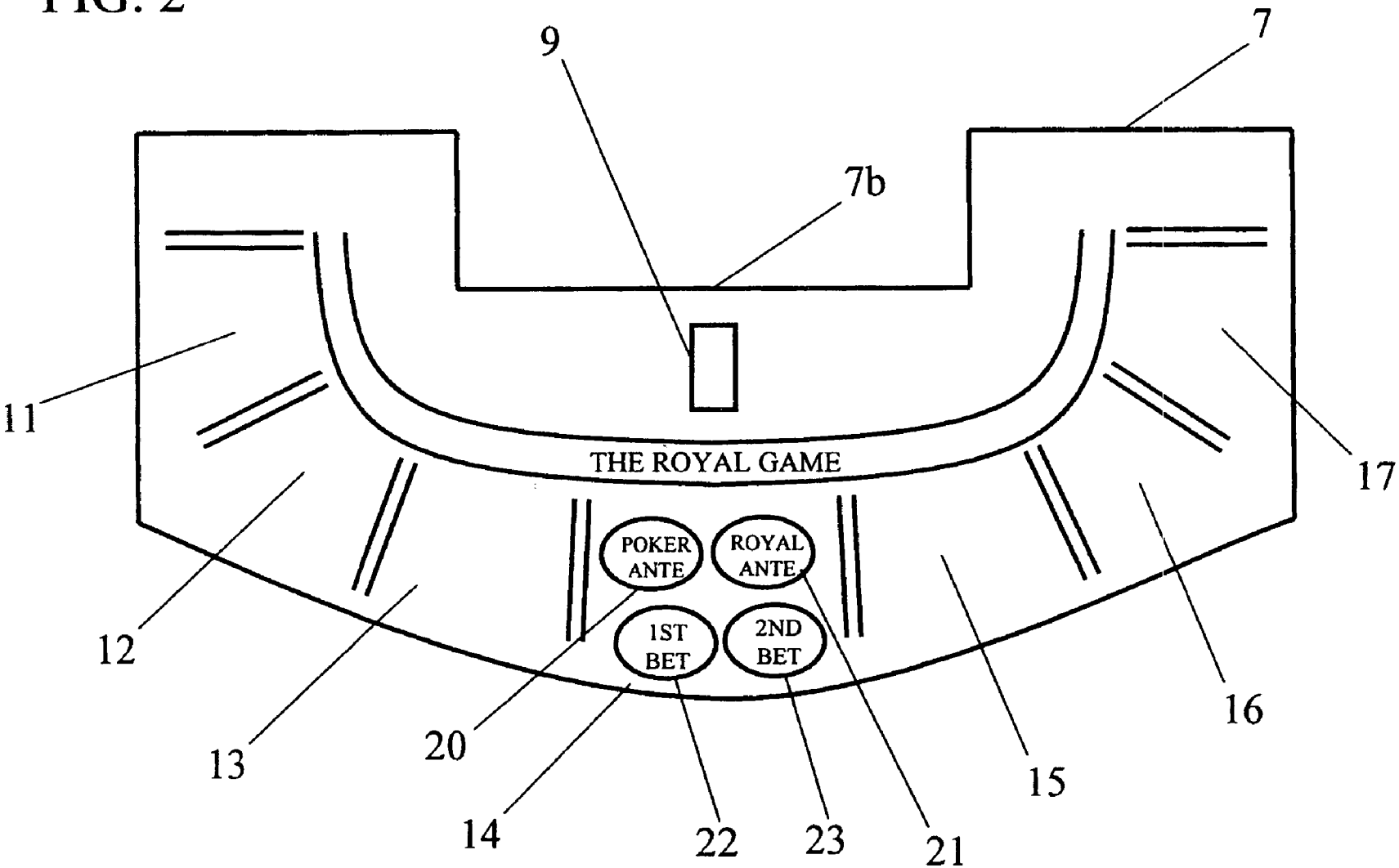
FIG. 2 presents a gaming table layout for a gaming table in accordance with an embodiment of the present invention.

FIG. 2 presents a gaming table layout for a gaming table in accordance with the embodiment of the present invention for play by players and a dealer at a gaming table. As shown in FIG. 2, the table 7 includes a deck placement area 9 on the dealer side of the table 10 and seven player areas 11, 12, 13, 14, 15, 16, 17 on the players' side of the table, opposite the dealer side 10. Each player area 11, 12, 13, 14, 15, 16, 17 includes four marked areas, a Poker ante spot 20 for placement of a Poker game ante, an auxiliary game ante spot 21, and two betting spots 22, 23.

Figure 3:
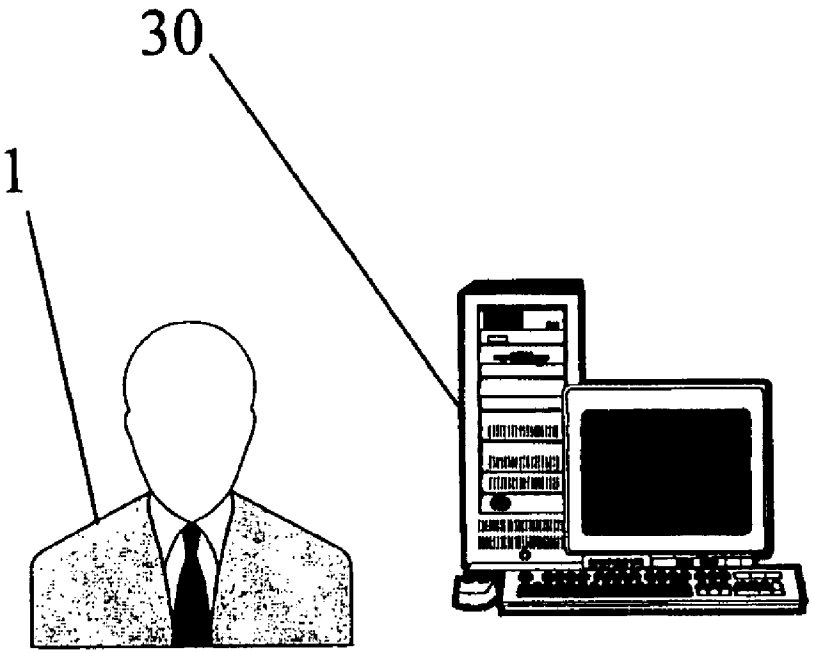
FIG. 3 depicts the components for electronic play of the game in accordance with one embodiment of the present invention.

FIG. 3 depicts the components for electronic play of the game in accordance with one embodiment of the present invention. As shown in FIG. 3, in this embodiment, the player 1 plays at a terminal 30, such as a personal computer, a minicomputer, a microcomputer, a main frame computer, or other device having a display, processor, and GUI, including a hand-held electronic game, a personal digital assistant, or a slot machine.

Figure 4:
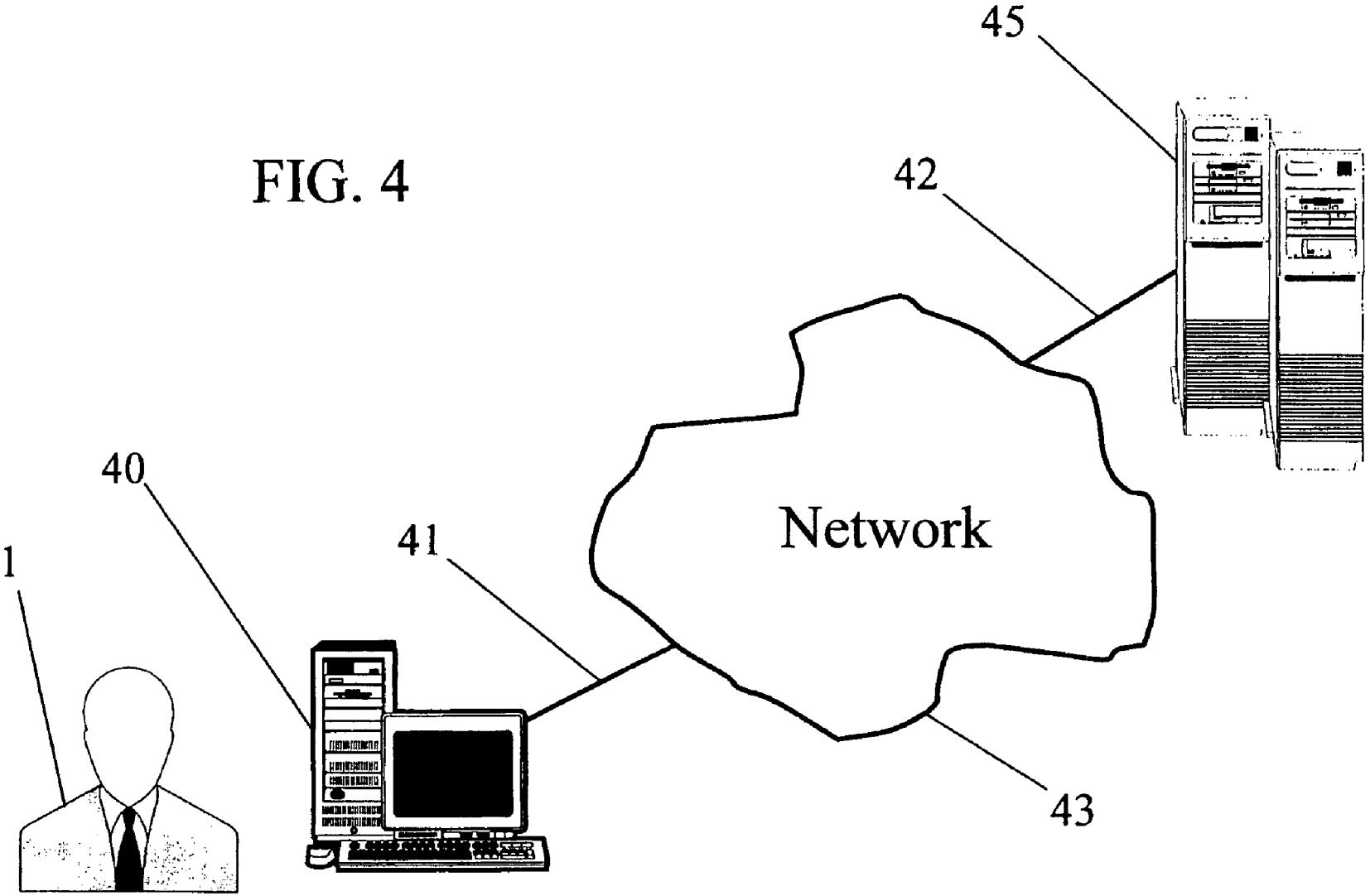
FIG. 4 presents components for electronic play of the game using a network in accordance with another embodiment of the present invention.

FIG. 4 presents components for electronic play of the game using a network, such as the Internet or an intranet, in accordance with another embodiment of the present invention. As shown in FIG. 4, a player 1 plays at a terminal 40, such as a personal computer, a minicomputer, a microcomputer, a main frame computer, or other device having a display and processor. The terminal 40, is connected 41, 42 via, for example, wire, wireless, or fiberoptic coupling to a network 43, such as the Internet or an intranet, to a server 45, such as personal computer, a minicomputer, a microcomputer, a main frame computer, or other device having a processor, and optionally including a repository, such as a database, or connection to a database.

Figure 5:
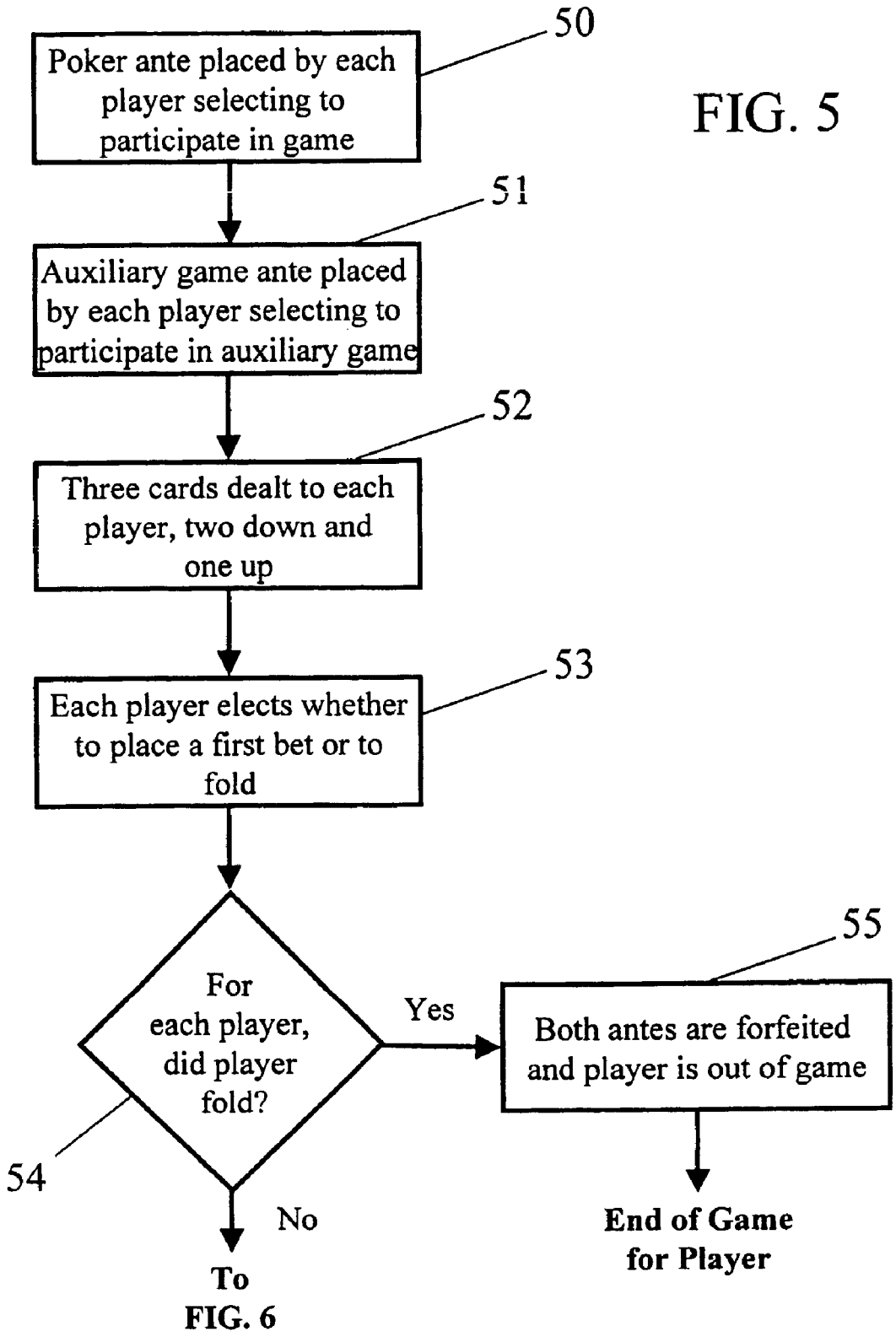
FIGS. 5-7 show a flow diagram of an example method of play in accordance with an embodiment of the present invention.
Figure 6:
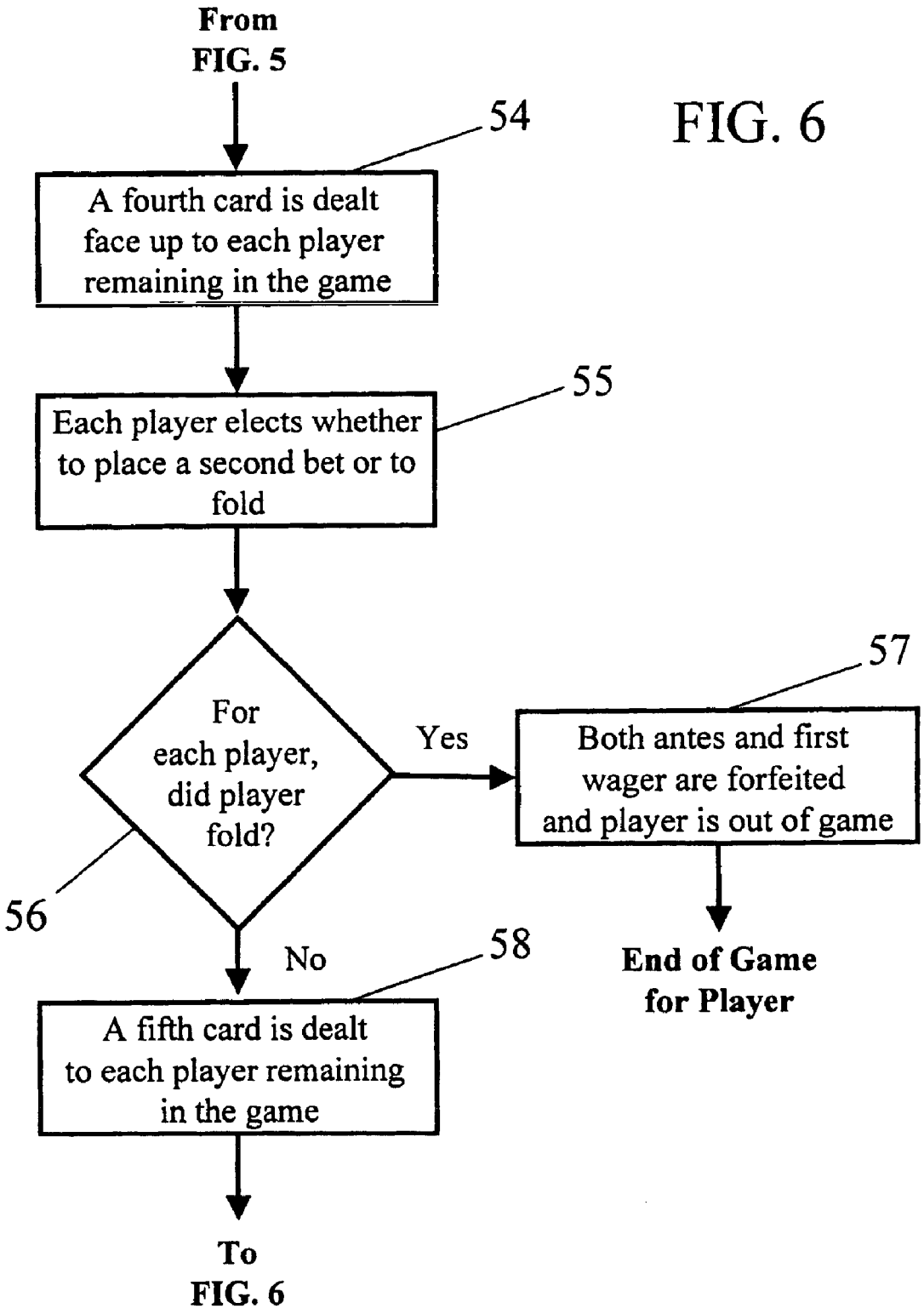
Figure 7:
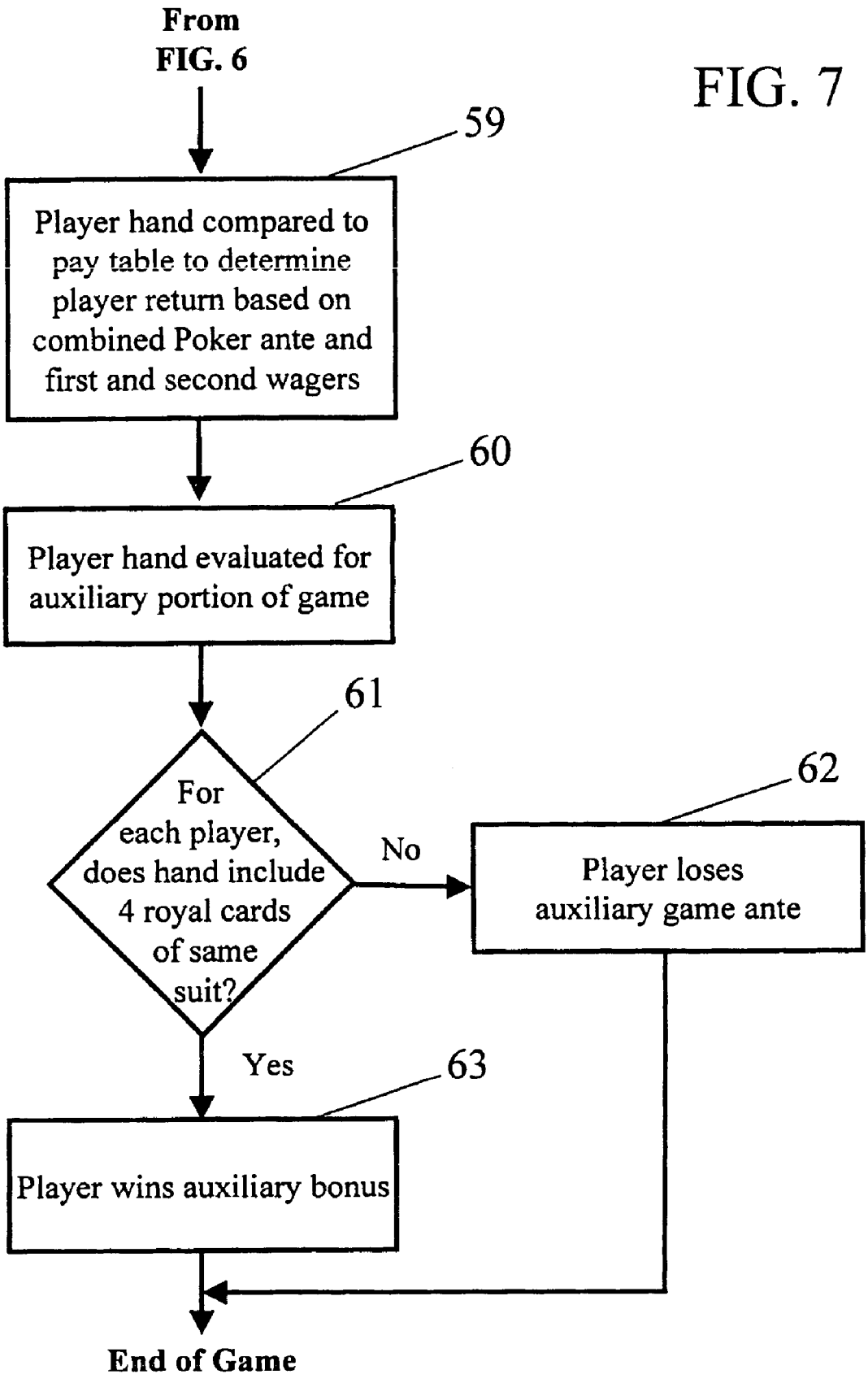

FIGS. 5-7 show a flow diagram of an example method of play for an exemplary embodiment of the present invention, in which play of the Poker portion of the game is in accordance with rules for Five Card Stud. As shown in FIG. 5, each player elects whether to play in the Poker portion of the game 50, such as by placing a Poker ante, and whether to play in the auxiliary game 51, such as by placing an auxiliary game ante. Each participating player is then dealt two cards down and one card up 52, for example, in accordance with the rules of Five Card Stud. Each player selects to place a first wager (e.g., by placing the wager in a first betting location) or to fold 53. In an embodiment of the present invention, the minimum first wager is equal to the Poker game portion ante amount.

Following placement of all first wagers or folding, for each player folding 54, both antes are forfeited and the player is out of the game 55. For each player placing a wager 54, a second face up card is dealt 54 (fourth overall card dealt to player). Each player then selects whether to place a second wager (e.g., by placing the wager in a second betting location) or to fold 55. Following placement of all second wagers or folding, each player folding forfeits both antes and the first bet and is out of the game 57. Each player placing a second wager 56 is dealt a final card 58, either face up or face down, depending on house rules. Optionally, in accordance with some house rules, players may also select to trade one or more received cards for newly dealt cards or optionally to pass on betting a second wager, but to elect to remain in the game.

Following dealing of all hands, the hands of each player remaining in the game are revealed, and all wager payouts for the Poker portion of the game are determined 59. For example, players having hands listed on a payout table are paid returns on their wagers based on the payout table returns indicated (e.g., players having three of a kind receive 2:1 returns on wagers if so indicated in the payout table). Other returns are usable with the present invention, in addition to returns via a pay table, such as by comparing hands among players or by comparing each player's hand to a dealer's hand. In addition, the hands of all players remaining in the game and participating in the auxiliary game are evaluated with regard to the auxiliary game 60. All players not having the appropriate "royal" cards in their hands lose their auxiliary game ante. All players having the appropriate "royal" cards in their hands receive the bonus prize or are allowed to participate in a random bonus prize selection event 63 (e.g., turn of a prize wheel).

Example embodiments of the present invention have now been described in accordance with the above advantages. It will be appreciated that these examples are merely illustrative of the invention. Many variations and modifications will be apparent to those skilled in the art.

What is claimed is:

1. A method for at least one player to play a card game comprising:

receiving a card game ante from each of the at least one player, the card game ante indicating participation in the card game, wherein the card game comprises a Poker game and an auxiliary play, the Poker game played according to the standard rules of Poker and having at least five cards per hand, wherein a card game payout corresponding to each hand is determined regardless of a dealer hand;

receiving an auxiliary play ante from each of the at least one player, the auxiliary play ante indicating participation in the auxiliary play, wherein the auxiliary play is based on the hand of the respective player in the Poker game, wherein the auxiliary play comprises a bonus prize corresponding to each hand having four royal cards out of the at least five cards, wherein the four royal cards comprise any four of an ace, a king, a queen, a jack, and a ten, and wherein the four royal cards comprise cards of the same suit;

dealing at least one card from at least one deck of cards to each remaining one of the at least one player in each of a plurality of rounds in accordance with the card game until the at least one player receives the at least five cards;

receiving a selection from each remaining one of the at least one player whether to wager in at least a first one of the plurality of rounds;

for each of the at least one player selecting to wager in the first one of the plurality of rounds, taking a first wager;

for each of the at least one player selecting not to wager in the first one of the plurality of rounds:

taking the card game ante;

taking the auxiliary play ante; and removing the respective player from the card game and the auxiliary game;

receiving a selection from each remaining one of the at least one player whether to wager in at least a second one of the plurality of rounds, wherein the second one of the plurality of rounds comes after the first one of the plurality of rounds;

for each of the at least one player selecting to wager in the second one of the plurality of rounds, taking a second wager;

for each of the at least one player, selecting not to wager in the second one of the plurality of rounds:

taking the card game ante;

taking the auxiliary play ante;

taking the first wager; and removing the respective player from the card game and the auxiliary game;

determining whether each of the at least one player remaining in the card game through the plurality of rounds, receiving the at least five cards, and participating in the auxiliary play was dealt the four royal cards out of the at least five cards; and for each one of the at least one player remaining in the card game through the plurality of rounds, receiving the at least five cards, and participating in the auxiliary play having the four royal cards out of the at least five cards, awarding the bonus prize.

2. The method of claim 1, wherein dealing further comprises:

dealing two cards down and one card up to each of the at least one player in the first one of the plurality of rounds.

3. The method of claim 2, wherein dealing comprises:

dealing one card up to each of the at least one player remaining in the card game in the second one of the plurality of rounds.

4. The method of claim 3, wherein dealing comprises:

dealing one card, either up or down, to each of the at least one player remaining in the card game in a third one of the plurality of rounds, wherein the third one follows the second one of the plurality of rounds.

5. The method of claim 1, further comprising:

determining the card game payout based on a predetermined payout table for each of the at least one player remaining in the card game through the plurality of rounds, and receiving the at least five cards; and awarding the respective card game payout for each one of the at least one player remaining in the card game through the plurality of rounds, and receiving the at least five cards.

6. The method of claim 1, further comprising:

determining the card game payout for each of the at least one player remaining in the card game through the plurality of rounds, and receiving the at least five cards, the card game payout based on a comparison of each respective hand of each of the at least one player remaining in the card game; and awarding the respective card game payout for each one of the at least one player remaining in the card game through the plurality of rounds, and receiving the at least five cards.

7. The method of claim 1, wherein dealing comprises dealing a representation of a card.

8. A system for at least one player to play a card game with representation of a cards, comprising:

at least one input device for the at least one player to input data for playing the card game;

a processor coupled to the at least one input device for receiving input data from the at least one input device; and at least one display device coupled to the processor for displaying display information;

wherein the processor is operable to:

receive a card game ante from each of the at least one player, the card game ante indicating participation in the card game, wherein the card game comprises a Poker game and an auxiliary game, the Poker game played according to the standard rules of Poker and having at least five cards per hand, wherein a card game payout corresponding to each hand is determined regardless of a dealer hand;

receive an auxiliary game ante from each of the at least one player, the auxiliary game ante indicating participation in the auxiliary game, wherein the auxiliary game is based on the hand of the respective player in the Poker game, wherein the auxiliary game comprises a bonus prize corresponding to each hand having four royal cards out of the at least five cards, wherein the four royal cards comprise any four of an ace, a king, a queen, a jack, and a ten, and wherein the four royal cards comprise cards of the same suit;

deal at least one card from at least one deck of cards to each remaining one of the at least one player in each of a plurality of rounds in accordance with the Poker game until the at least one player receives the at least five cards;

receive a selection from each remaining one of the at least one player whether to wager in at least a first one of the plurality of rounds;

for each of the at least one player selecting to wager in the first one of the plurality of rounds, take a first wager;

for each of the at least one player selecting not to wager in the first one of the plurality of rounds:

take the card game ante;

take the auxiliary game ante; and take the respective player out of the card game and the auxiliary game;

receive a selection from each remaining one of the at least one player whether to wager in at least a second one of the plurality of rounds, wherein the second one of the plurality of rounds comes after the first one of the plurality of rounds;

for each of the at least one player selecting to wager in the second one of the plurality of rounds, take a second wager;

for each of the at least one player, selecting not to wager in the second one of the plurality of rounds:

take the card game ante;

take the auxiliary game ante;

take the first wager; and remove the respective player from the card game and the auxiliary game;

determine whether each of the at least one player remaining in the card game through the plurality of rounds, receiving the at least five cards, and participating in the auxiliary game was dealt the four royal cards out of the at least five cards; and award the bonus prize for each one of the at least one player remaining in the card game through the plurality of rounds, receiving the at least five cards, and participating in the auxiliary game having the four royal cards out of the at least five cards.

9. The system of claim 8, further comprising a terminal.

10. The system of claim 8, further comprising at least one terminal on a network.

11. The system of claim 10, further comprising a server on the network.

12. The system of claim 11, wherein the at least one terminal and the server are coupled via a coupling.

13. The system of claim 12, wherein the coupling comprises one from the group consisting of a wired connection, a wireless connection, and a fiberoptic connection.

14. The system of claim 10, wherein the at least one terminal comprises one selected from a group consisting of a personal computer, a minicomputer, a microcomputer, a main frame computer, a telephone device, and a personal digital assistant.

15. The system of claim 11, wherein the server comprises one selected from a group consisting of a personal computer, a minicomputer, a microcomputer, and a main frame computer.

16. The system of claim 10, wherein the network is the Internet.

17. The system of claim 10, wherein the network is an intranet.

18. A method of playing a card game, comprising:

dealing to at least one player a hand of at least five cards from at least one deck of playing cards;

establishing a card game including each respective hand, wherein the card game comprises a Poker game portion and an auxiliary game portion, wherein the Poker game portion is playable in conjunction with the standard rules for Poker and comprises a Poker game payout, wherein the auxiliary game portion comprises a bonus prize, wherein both the Poker game payout and the bonus prize are based on the at least five cards in each respective hand, wherein the bonus prize corresponds to each respective hand having four royal cards out of the at least five cards, wherein the four royal cards comprise any four of an ace, a king, a queen, a jack, and a ten, and wherein the four royal cards comprise four cards of the same suit;

receiving a Poker game portion ante, at least one Poker game portion wager, and an auxiliary game portion ante from each of the at least one player, wherein the Poker game portion ante comprises an indication of participation in the Poker game portion, wherein the auxiliary game portion ante comprises an indication of participation in the auxiliary game portion;

for the Poker game portion of the card game, determining the Poker game payout for each hand based on the at least five cards in the respective hand, wherein determining the Poker game payout for each hand is further based on receiving the Poker game portion ante and the at least one Poker game portion wager; and for the auxiliary game portion of the card game, determining the bonus prize for each hand based on any four of the at least five cards in the respective hand comprising the four royal cards, wherein determining the bonus prize for each hand is further based on receiving the auxiliary game portion ante.

19. The method of claim 18, wherein dealing comprises dealing a representation of a card.

20. The method of claim 18, wherein dealing from at least one deck of playing cards comprises dealing from each deck of playing cards comprising values of ace, two, three, four, five, six, seven, eight, nine, ten, jack, queen and king in each of four different suites.

21. The method of claim 18, wherein dealing from at least one deck of playing cards comprises dealing from each deck of playing cards comprising values of ace, two, three, four, five, six, seven, eight, nine, ten, jack, queen and king in each of four different suites, and further comprising at least one joker.

22. The method of claim 18, further comprising receiving a card game ante from each player, the card game ante comprising the Poker game portion ante and the auxiliary game portion ante, and wherein determining the Poker game payout for each hand is further based on receiving the card game ante.

23. The method of claim 22, wherein determining the bonus prize for each hand is further based on receiving the card game ante.

24. The method of claim 18, further comprising receiving a card game ante from each player, the card game ante comprising the Poker game portion ante and the auxiliary game portion ante and further comprising an indication of participation in both the Poker game portion and the auxiliary game portion, and wherein determining the bonus prize for each hand is further based on receiving the card game ante.

25. The method of claim 18, further comprising:

receiving a card game ante from each player, the card game ante comprising the Poker game portion ante and the auxiliary game portion ante;

wherein dealing further comprises dealing at least one card to each remaining player in each of a plurality of rounds in accordance with the Poker game portion until the at least one player receives the at least five cards;

receiving a selection from each player whether to wager in at least a first one of the plurality of rounds;

for each player selecting to wager in the first one of the plurality of rounds, taking a first Poker game portion wager;

for each player selecting not to wager in the first one of the plurality of rounds:

taking the card game ante; and taking the respective player out of the Poker game portion and the auxiliary game portion.

26. The method of claim 25, further comprising:

receiving a selection from each player remaining after the first one of the plurality of rounds whether to wager in at least a second one of the plurality of rounds;

for each player selecting to wager in the second one of the plurality of rounds, taking a second Poker game portion wager;

for each player selecting not to wager in the second one of the plurality of rounds:

taking the card game ante;

taking the first Poker game portion wager; and taking the respective player out of the Poker game portion and the auxiliary game portion.

27. The method of claim 26, further comprising:

receiving a selection from each player remaining after a second to last one of the plurality of rounds whether to wager in a last one of the plurality of rounds;

for each player selecting to wager in the last one of the plurality of rounds, taking a last Poker game portion wager;

for each player selecting not to wager in the last one of the plurality of rounds, taking at least one of the following actions:

receiving an indication corresponding to a pass, and then determining the Poker game payout and the bonus prize;

receiving an indication corresponding to a trade-in of a number of cards, dealing a number of new cards corresponding to the number of trade-in cards, and then determining the Poker game payout and the bonus prize, or receiving an indication to corresponding to a fold and taking the card game ante, all of the respective Poker game portion wagers and taking the respective player out of the Poker game portion and the auxiliary game portion; and receiving an indication corresponding to a fold, taking the card game ante, all of the respective Poker game portion wagers, and taking the respective player out of the Poker game portion and the auxiliary game portion.

28. The method of claim 18, further comprising:

awarding the Poker game payout for each hand according to the respective Poker game payout determination; and awarding the bonus prize for each hand according to the respective bonus prize determination.

29. The method of claim 28, wherein awarding the bonus prize for each hand further comprises awarding the bonus prize based on receiving a card game ante corresponding to the respective hand, wherein the card game ante comprises the Poker game portion ante and the auxiliary game portion ante.

30. The method of claim 28, wherein awarding the bonus prize for each hand further comprises awarding the bonus prize based on receiving the auxiliary game portion ante corresponding to the respective hand.

31. The method of claim 28, wherein awarding the Poker game payout for each hand further comprises awarding the Poker game payout according to a Poker game payout determination based on at least one of a predetermined payout table and a comparison between respective hands of respective players.

32. The method of claim 28, wherein awarding the Poker game payout for each hand further comprises awarding the Poker game payout according to a Poker game payout determination regardless of a dealer hand.

33. A device for at least one player to play a card game with representations of cards, comprising:

an input device for the at least one player to input data for playing the card game;

a payment input for the at least one player to input payment;

a processor coupled to the input device for receiving the input data from the input device; and a display device coupled to the processor for displaying display information;

wherein the payment input is operable to receive a card game ante from each of the at least one player, the card game ante indicating participation in the card game, wherein the card game comprises a Poker game and an auxiliary game, the Poker game played according to the standard rules of Poker and having at least five cards per hand, wherein a card game payout corresponding to each hand is determined regardless of a dealer hand;

wherein the payment input is operable to receive an auxiliary game ante from each of the at least one player, the auxiliary game ante indicating participation in the auxiliary game, wherein the auxiliary game is based on the hand of the respective player in the Poker game, wherein the auxiliary game comprises a bonus prize corresponding to each hand having four royal cards out of the at least five cards, wherein the four royal cards comprise any four of an ace, a king, a queen, a jack, and a ten, and wherein the four royal cards comprise cards of the same suit;

wherein the processor is operable to:

deal at least one card from at least one deck of cards to each remaining one of the at least one player in each of a plurality of rounds in accordance with the card game until the at least one player receives the at least five cards;

receive a selection from each remaining one of the at least one player whether to wager in at least a first one of the plurality of rounds;

for each of the at least one player selecting to wager in the first one of the plurality of rounds, take a first wager;

for each of the at least one player selecting not to wager in the first one of the plurality of rounds:

take the card game ante;

take the auxiliary game ante; and take the respective player out of the card game and the auxiliary game;

receive a selection from each remaining one of the at least one player whether to wager in at least a second one of the plurality of rounds, wherein the second one of the plurality of rounds comes after the first one of the plurality of rounds;

for each of the at least one player selecting to wager in the second one of the plurality of rounds, take a second wager;

for each of the at least one player, selecting not to wager in the second one of the plurality of rounds:

take the card game ante;

take the auxiliary game ante;

take the first wager; and take the respective player out of the card game and the auxiliary game;

determine whether each of the at least one player remaining in the card game through the plurality of rounds, receiving the at least five cards, and participating in the auxiliary game was dealt the four royal cards out of the at least five cards; and award the bonus prize for each one of the at least one player remaining in the card game through the plurality of rounds, receiving the at least five cards, and participating in the auxiliary game having the four royal cards out of the at least five cards.

34. The device of claim 33, wherein the device comprises a slot machine.

35. A system for playing a card game, comprising:

at least one input device for at least one player to input data for playing the card game comprising representations of cards;

a processor coupled to the at least one input device for receiving input data from the at least one input device; and at least one display device coupled to the processor for displaying display information;

wherein the processor is operable to:

deal to each player a hand of at least five cards from at least one deck of playing cards;

establish the card game with respect to each respective hand, wherein the card game comprises a Poker game portion and an auxiliary game portion, wherein the Poker game portion is playable in conjunction with the standard rules for Poker and comprises a Poker game payout, wherein the auxiliary game portion comprises a bonus prize, wherein both the Poker game payout and the bonus prize are based on the at least five cards in each respective hand, wherein the bonus prize corresponds to each respective hand having four royal cards out of the at least five cards, wherein the four royal cards comprise any four of an ace, a king, a queen, a jack, and a ten, and wherein the four royal cards comprise four cards of the same suit;

for the Poker game portion of the card game, determine the Poker game payout for each hand based on the at least five cards in the respective hand; and for the auxiliary game portion of the card game, determine the bonus prize for each hand based on any four of the at least five cards in the respective hand comprising the four royal cards.

36. The system of claim 35, further comprising at least one terminal on a network, and at least one server on the network.

37. A device for playing a card game, comprising:

at least one input device for at least one player to input data for playing the card game comprising representations of cards;

a payment mechanism operable to receive a payment from the at least one player;

a processor coupled to the at least one input device for receiving input data from the at least one input device; and at least one display device coupled to the processor for displaying display information;

wherein the processor is operable to:

deal to each player a hand of at least five cards from at least one deck of playing cards;

establish the card game with respect to each respective hand, wherein the card game comprises a Poker game portion and an auxiliary game portion, wherein the Poker game portion is playable in conjunction with the standard rules for Poker and comprises a Poker game payout, wherein the auxiliary game portion comprises a bonus prize, wherein both the Poker game payout and the bonus prize are based on the at least five cards in each respective hand, wherein the bonus prize corresponds to each respective hand having four royal cards out of the at least five cards, wherein the four royal cards comprise any four of an ace, a king, a queen, a jack, and a ten, and wherein the four royal cards comprise four cards of the same suit;

for the Poker game portion of the card game, determine the Poker game payout for each hand based on the at least five cards in the respective hand; and for the auxiliary game portion of the card game, determine the bonus prize for each hand based on any four of the at least five cards in the respective hand comprising the four royal cards.

38. The device of claim 37, wherein the device comprises a slot machine.

* * * * *